United States Patent [19]

Lamanna

[11] Patent Number: 4,715,601

[45] Date of Patent: Dec. 29, 1987

[54] SET OF GOLF CLUBS AND METHOD OF MATCHING SAME

[76] Inventor: Anthony Lamanna, 24 N. 38 Valley Rd., Lake Zurich, Ill. 60047

[21] Appl. No.: 833,101

[22] Filed: Feb. 25, 1986

[51] Int. Cl.[4] ..... A63B 53/04

[52] U.S. Cl. ..... 273/77 A; 273/80.2; 273/169

[58] Field of Search ..... 273/77 A, 169, 171, 273/172, 167 F, 173, 174, 80 R, 80 A, 80.2

[56] References Cited

U.S. PATENT DOCUMENTS 3,655,188 4/1972 Solheim ..... 273/77 A
3,749,408 7/1973 Mills ..... 273/171

OTHER PUBLICATIONS

"The Washington Post" Jun. 30, 1977 p. E-3 Relied On.

*Primary Examiner*—George J. Marlo
*Attorney, Agent, or Firm*—Trexler, Bushnell, Giangiorgi & Blackstone, Ltd.

[57] ABSTRACT

There is disclosed a design concept for a set of golf club irons including at least a first and a second club, wherein each club comprises a club head and a shaft. Each club head of the set includes a hosel portion to which the shaft is attached and a blade portion, with the blade portion including a substantially planar face for striking a golf ball and a back portion opposite said planar face. As with all iron clubs the substantially planar faces on the respective club heads of the set are disposed at varying angles with respect to a vertical datum line to provide progressive degrees of loft. In one preferred form the back portions of each club head of the set include a cavity formed therein, with the volume of the cavities in said clubs decreasing from the lower lofted clubs of said set to the higher lofted clubs. Further, the hosel length on said club heads increases from the lower lofted clubs to the higher lofted clubs of said set, such that the hosel length may be selected to provide a relatively uniformly located center center of mass for each club head in the set. The feature of varying hosel length and cavity size may be employed separately or in combination. Further, there is disclosed an iron club head design wherein the back portion of the blade includes a rib extending about the finished surfaces of said back portion, which rib can be ground off to adjust club head weight without damaging the club head finish.

12 Claims, 9 Drawing Figures

SET OF GOLF CLUBS AND METHOD OF MATCHING SAME

BACKGROUND OF THE INVENTION

The present invention relates to the game of golf and more particularly to an improved design concept for a set of golf clubs.

The game of golf is probably at the height of its popularity, and designers of golf clubs are striving to attain not only better quality equipment, but also equipment that will facilitate the play of the game. As is generally known, sets of golf clubs comprise two types of clubs, basically woods and irons. The present invention relates to the design of the iron type club.

Present day iron club designs fall into two general categories; first, the traditional type of design wherein the iron is forged and has a generally continuous back portion on the club blade; the second type of iron design is referred to as the "cavity back" design wherein the back portion of the club blade includes a substantial depression or cavity which has the effect of providing perimeter weighting for the club head. In contrast with the more conventional solid back iron, perimeter weighting provides a larger "sweet spot" or hitting area. That is to say, the cavity back type of club head is rather forgiving and is designed so that the ball does not have to be struck precisely in the center of mass of the club to attain acceptable results.

In order for the reader to appreciate fully the concept of the present invention, some basic principles of golf club design and more specifically the design of iron type golf clubs are reviewed hereinafter. The present disclosure is, however, directed to one skilled in the art of the design of golf clubs and as such certain well known terms of art will be employed without detailed explanation. In this regard, it will be readily appreciated that a set of irons comprises a plurality of clubs commencing with the clubs of lesser loft, as for example the two-iron and three-iron and progressing toward the clubs of greater loft, such as the eight-iron, nine-iron and pitching wedge. The length of the club shaft employed with each iron varies with the loft of the club, such that the lower numbered, less lofted irons have longer shafts than the higher numbered, more lofted irons. One of the desired features of golf club designs is to attain a relatively uniform swing weight from club-to-club throughout the set of irons. In order to attain the desired uniformity in swing weight, it is necessary that the club heads vary in their weight and mass, in relation to the varying lengths of shaft employed. That is to say, with the longer shaft on a two-iron, the two-iron club head will be of a lesser mass or weight than the club head of a nine-iron, which utilizes a shaft of shorter length. In this regard, attention is invited to the table which can be found in the detailed description of the invention and the various dimensional features noted therein.

With the above discussion in mind, attention is now directed to some of the problems encountered with present day iron club designs, both those of the traditional style and those of the cavity back style. With both types of prior art designs, the length of the hosel on the club head is relatively constant from club-to-club in the set. The hosel is the tubular portion of the club head which has the shaft affixed thereto. With the hosel length constant from club-to-club, the location of the center of mass will vary with the respective clubs. More specifically, with a two-iron and the lesser mass of the club head, the center of mass will be closer to the hosel, than will be the center of mass for a more lofted iron, such as a nine-iron. Thus, with present day designs, as we progress through a set of clubs starting with the lower lofted irons, the location of the center of mass moves outwardly along the club head blade away from the hosel and toward the toe of the blade. This variance in the location of the center of mass or the "sweet spot" is an undesirable feature that can adversely effect play. This phenomenon or disadvantage is present not only with the traditional forged type irons, but also with the cavity back irons. As will be discussed in further detail hereinafter, the employment of a cavity back type of iron presents even greater problems when a constant hosel length is used.

With a cavity back type of iron, the present day designs utilize a relatively uniform cavity size or dimension from club-to-club. That is to say, the approximate volume of the cavity for a two-iron will be about the same as that for a nine-iron or pitching wedge. Keeping in mind the fact that the weight of the club head increases as we progress through the clubs of the set, with the cavity volume remaining approximately constant, the increase mass of the club can only be accommodated at two locations, that is the increased weight can be placed either on the sole of the club, or proximate the toe of the club, or portion allocated to both locations. Consequently, there is provided a club head either with a relatively thick sole and/or an oversized, weighted toe portion. Both of these are undesirable features in higher lofted iron clubs. The placement of increased or excess weight in the sole of the clubs causes the ball to fly higher than desired. With the elevated loft of the club face there is no need for this increased sole weighting. The addition of weight at the toe location of the higher lofted club is also undesirable, as this will cause the club face to close during the golf swing. With the center of mass disposed relatively outward toward the toe, the closing of the club face can produce errant shots, or at the very least, shots of lesser accuracy than is demanded by the more skilled players of the game of golf. It is for this reason, that the cavity backed or forgiving type of iron is rarely employed by a professional or tour player.

Further, with respect to the lower numbered less lofted irons of the cavity backed design, the employment of a substantially uniform cavity generally results in a compromise, with the volume of the cavity being determined for the intermediate lofted clubs, such as the five-iron or six-iron. Thus, with the lower lofted clubs in the two and three-iron range there is not attained a sufficient degree of sole and toe weighting that is beneficial with the lower lofted clubs. With the lower lofted clubs it is preferred to have a considerable amount of the club head weight or mass proximate the sole and toe areas to prevent the blade from opening during striking of the ball, and also to place a substantial amount of mass below the ball to assist in attaining the desired angle of flight. As anyone who has played the game of golf can attest, it is often difficult to get the golf ball airborne with the lower lofted clubs, such as a one-iron, two-iron or three-iron.

The golf club design of the present invention overcomes the above-discussed disadvantages by employing a number of features which can be utilized independently or in combination to provide an improved, more playable iron type club. Initially, one of the important features of the present invention is the employment of an iron club head design for the various clubs of the set wherein the hosel portion on the lower lofted irons are of a shorter length, and therefore less mass or weight than are the hosel portions on the higher lofted irons. Thus, as the club head weight increases from the lower lofted to the higher lofted irons, the weight of the hosel portion also increases which permits the center of mass or "sweet spot" to be maintained at a relatively constant location in relation to the blade portion of the club head, and the planar face of said blade portion. Secondly, the present invention envisions employment of a cavity back type of club to attain the benefits of perimeter weighting, which as it will be recalled is the attainment of an enlarged "sweet spot" or hitting area and a more forgiving type club. That is to say, even if the ball is struck slightly off center relatively acceptable results can be attained. In this regard, the size or volume of the cavity in terms of the mass of material that is effectively removed from the blade due to the presence of a cavity is varied from club-to-club, with the lower lofted irons having a larger cavity than that employed with the higher lofted irons.

The advantages attained with the varying of the cavity size are significant and several in number. Initially, it must be kept in mind that in designing a set of iron clubs the approximate weight of the various club heads is first determined. Thus, given a particular club head weight for a lower lofted iron, the employment of a larger cavity permits placement of a predetermined portion of the club head mass or weight proximate the sole and toe sections of the club head. The increase mass in the sole section is desirable in that it facilitates getting the ball airborne and results in attainment of the desired trajectory for the shot. The placement of weight in the toe of the club is beneficial in that this weight and moment generated during the swing will tend to offset the torque generated upon striking the ball, and prevent the blade from opening during the dynamic portion of the golf swing, viz., that portion of the stroke when the ball is struck and the energy from the club head is transmitted to the golf ball. With the higher lofted irons, a smaller cavity is employed, which has the effect of enabling the designer to provide a smaller overall club head. In this regard, if the cavity size were the same for the two-iron as for the nine-iron, considerably more weight would have to be provided proximate the sole and toe portion of the nine-iron as the club head weight is greater. Since only so much weight can be added to the sole portion of the club before the size thereof becomes unsightly and a hinderance, the end result is that most of the excess weight is placed in the toe portion resulting in extremely large, elevated toe segment and a somewhat oversized or larger club head than is desired. With the present invention, the varying of the cavity size enables the provision of a lower toe portion and a smaller overall club head configuration. Further, since less of the club head weight is allocated to the sole and toe portions, the club design of the present invention is not subject to the disadvantages discussed above with the prior art cavity back designs. That is to say, the smaller cavity for the short irons allows a more even distribution of weight across the entire back of the blade, thus enabling the size of the club head to be smaller and avoiding excessive toe and sole weighting.

The present invention provides still an additional feature which facilitates fabrication of the iron type clubs. More specifically, the rear portion of the club head, that is the portions in which the cavity is formed includes a rim or ridge extending about the entire periphery of the club head, which permits the club head weight to be adjusted after the club head has been finished. In practice, the club heads are forged and finished to an approximate or target weight by a foundry. In the assembly of the club head to the shaft a desired swing weight is sought to be attained. Quite often, it is necessary to remove or add a slight amount of weight from the club head in order to achieve the desired swing weight. With the present invention, the rim about the periphery of the rear portion of the club head can be ground to permit attainment of the desired swing weight, without adversely effecting the finish of the club head disposed inwardly of the rim portion.

BRIEF DESCRIPTION OF THE DRAWINGS

The features of the present invention which are believed to be novel are set forth with particularity in the appended claims. The organization of the invention, together with further objects and advantages thereof, may best be understood by reference to the following detailed description of the illustrated embodiment, taken in conjunction with the accompanying drawings wherein like reference numerals identify like elements, and wherein:

DETAILED DESCRIPTION OF THE ILLUSTRATED EMBODIMENT

Figure 1:
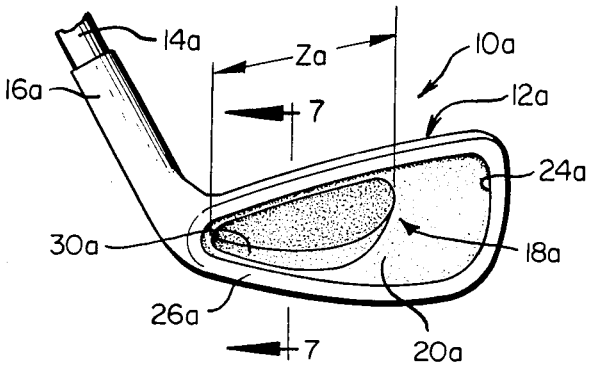
FIG. 1 is a rear elevational view of a lower lofted club head, such as a two-iron, constructed in accordance with the present invention.
Figure 2:
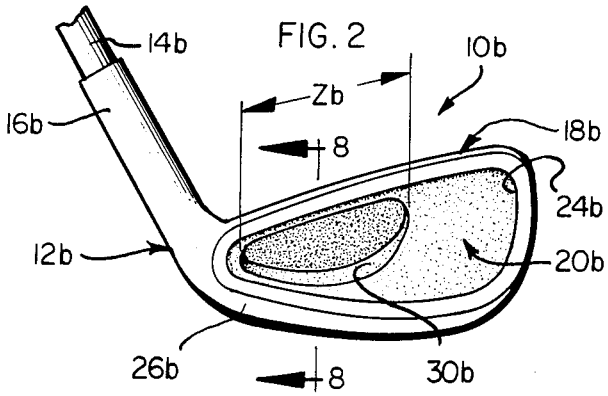
FIG. 2 is a view similar to FIG. 1 of a medium lofted club head, namely a six-iron.
Figure 3:
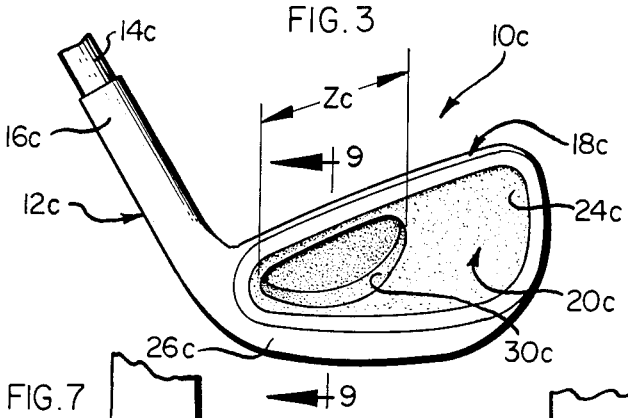
FIG. 3 is a view similar to FIGS. 1 and 2 of a higher lofted club, in this instance a pitching wedge.

Referring now to the drawings, and initially to FIGS. 1–3, rear elevational views of iron type club heads designed in accordance with the present invention are shown. In this regard, a set of iron clubs will normally include anywhere between eight and eleven separate clubs, as for example, a set may comprise one-iron through the sand wedge, or three-iron through pitching wedge. FIGS. 1–3 illustrate three clubs which may be found in a typical set, namely the two-iron, six-iron and pitching wedge, respectively, and these figures are believed to be illustrative of the principles of the present invention, as applied to an entire set of clubs.

With reference to FIGS. 1–3, the clubs are designated generally **10*a*, 10*b* and 10*c*, and the various components or features of the respective clubs and club heads are identified by the sub-designations "a", "b" and "c", with similar reference numerals being used for like components in the various figures. Thus, each club 10*a–c* includes a club head 12 and a shaft 14 affixed to the club head 12. The club heads 12*a–c* each comprise a hosel portion 16 and a blade portion 18, the hosel portion 16 being hollow or tubular and having the shaft 14 received therein and bonded or otherwise mechanically affixed thereto. In this regard, it is well-known in the art to utilize an epoxy resin to bond the golf shaft to the club head, or alternately to use some form of mechanical interlock such as a screw connection or a set screw. In some instances both a mechanical connection and bonding are employed to mount the club head on the shaft end. As will be recalled from the previous discussion, the shafts 14***a–c* will vary in length with the lower lofted club 10*a* having a shaft 14*a* which is longer than the shaft 14*c* employed with the higher lofted club head 12*c*.

Figure 4:
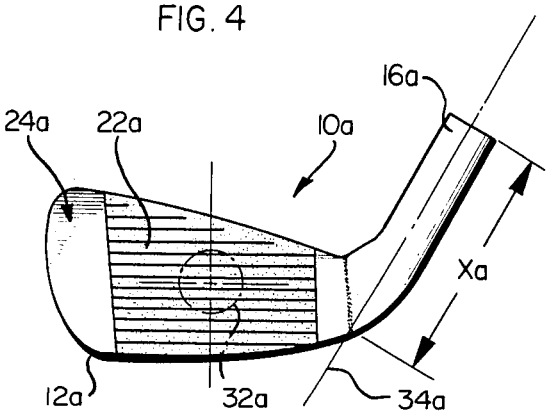
FIG. 4 is a front elevational view of the club of FIG. 1.
Figure 5:
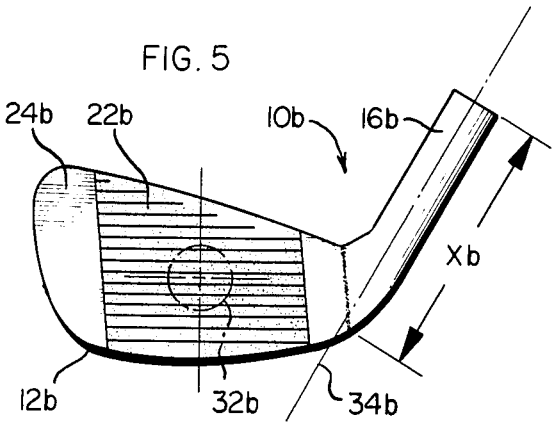
FIG. 5 is a front elevational view of the club of FIG. 2.
Figure 6:
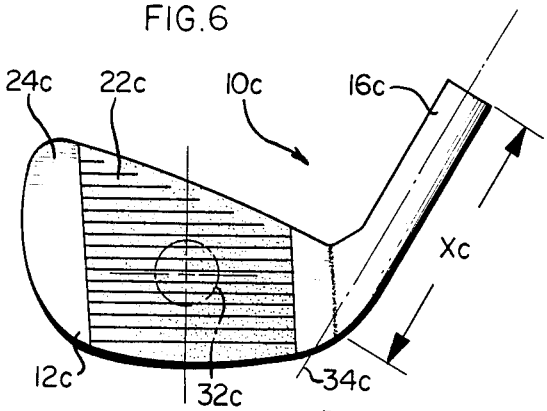
FIG. 6 is a front elevational view of the club of FIG. 3.

Taking into account all of the figures, it can be seen that each blade portion 18*a–c* includes a back portion 20, FIGS. 1–3, as well as a planar club head face 22, FIGS. 4–6. As can be appreciated, the planar face 22 is utilized in striking the golf ball, and is provided with varying degrees of loft when progressing from the two-iron of FIG. 1 to the six-iron of FIG. 2 and the pitching wedge of FIG. 3. In this regard, attention is invited to FIGS. 7–9 which illustrate the increased loft of the club faces 22*a–c*, as well as the table included hereinafter in this description. Further, the blade 18 also includes a toe portion 24 and a sole portion 26, the latter being provided adjacent the lower edge of the blade. The back portion 20 of each club head 12*a–c* is provided with a cavity, the cavities being designated generally 30*a–c* and are shown in FIGS. 1–3 and 7–9.

Figure 7:
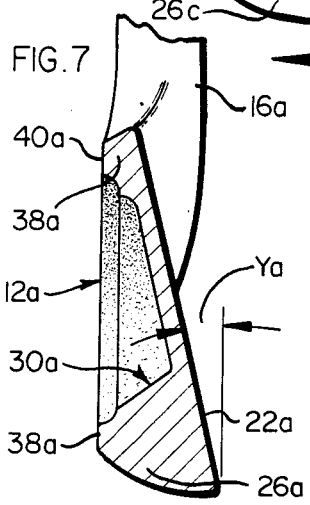
FIGS. 7–9 are sectional views taken along the lines 7—7 of FIG. 1, 8—8 of FIG. 2, and 9—9 of FIG. 3, respectively in the directions indicated.
Figure 8:
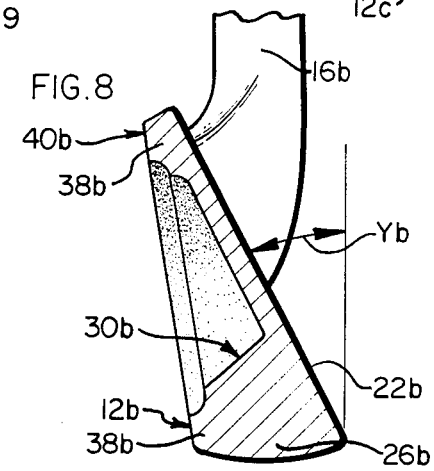
Figure 9:
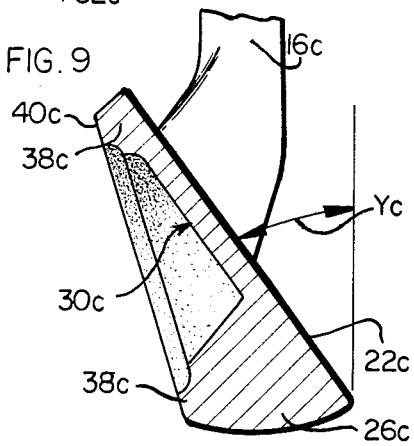

FIGS. 7–9 are sectional views taken through the two-iron, six-iron and pitching wedge respectively of FIGS. 1–3. These figures illustrate the shape of the cavities 30*a–c*, as well as the varying degree of inclination or loft provided for each of the club faces 22*a–c*. The degree of loft for each club head is indicated by the angles Ya–c, which are approximate in the drawings. For a more detailed indication of the degree of loft for each club, reference is again made to the following table of a typical club head designed in accordance with the present invention.

Directing attention again to FIGS. 4–6, it can be seen that the hosel portion 16*a* for the club head 12*a* is of a given length Xa. The lengths of the hosels 16*b* and 16*c* are designated Xb and Xc, respectively, with these lengths increasing from the lower lofted iron 10*a* through the higher lofted irons 10*b* and 10*c*. In practice, it has been found that the hosel length should be increased by approximately 0.1 inch per club, that is to say the length Xb of the hosel 16*b* for a six-iron will be approximately 0.4 inches longer than the hosel length Xa of a two-iron. Correspondingly, the length Xc of the hosel for the pitching wedge is approximately 0.8 of an inch longer than is the length Xa of the hosel 16*a*. With the increased length of the hosels 16*b* and 16*c* vis-a-vis the shorter hosel 16*a*, there is provided an increased weight or mass in the hosel portion of the clubs 10*b* and 10*c*. This increased weight can be employed to balance the increased weight of the club head (see following table) such that the center of mass or "sweet spot" for each club head, which is designated generally 32*a–c*, will remain in a relatively constant position with respect to the club face and the axis 34*a–c* of the hosels 16*a–c*.

As was discussed previously, the size or volume of the cavities 30*a–c* vary with the two-iron club head 12*a* having a larger cavity 30*a* than the cavities 30*b* and 30*c* provided for the six-iron, FIG. 2, and the pitching wedge FIG. 3, respectively. The respective cavities 30*a–c* extend along the blade 12, and this length is designated by the references Za–c. As can be appreciated, the length Za of the cavity 30*a* is considerably greater than the length Zc of the cavity 30*c*. Here again, reference is made to the following table and the column identified as cavity dimensions which illustrates the decrease in the length of the cavity 30 from the two-iron to the six-iron and through the pitching wedge, as well as through the remaining iron clubs of the set which are not illustrated.

In practice, it has also been found that the volume of the cavity 30 should decrease by an amount equal to one gram of weight from club-to-club in the set. That is to say, that the cavity 30*a*, if filled, would include approximately 20 grams of weight whereas the cavity 30*b* would include 16 grams of weight and the cavity 30*c* 12 grams of weight. Thus, with the larger cavity for the lower lofted irons, the weight of the club head can be distributed in the toe 24*a* and sole 26*a*. With regard to the higher lofted clubs, nine-iron and pitching wedge for example, the smaller cavity 30*c* permits the club head weight to be distributed more evenly over the blade 12*c*. Thus, with the higher lofted iron 10*c* and its increased weight (see following table) there is no need to concentrate weight in the toe section 24*c* or sole section 26*c*. The end result is that with this feature of the invention, namely varying the cavity size, increased toe and sole weighting can be achieved with the lower lofted irons 10*a*, and said weighting controlled or minimized with the higher lofted irons 10*c*. Thus, in the design of the higher lofted iron 10*c* a smaller overall club head configuration can be employed and there is no need to employ an oversized toe section, as is the case with numerous prior art types of cavity back club head designs. By way of demonstration and with reference to the following table, it can be appreciated that if the cavity 30*c* were of the same size as the cavity 30*a* an additional 8 grams of weight would have to be accommodated in the toe and sole portions 24*c* and 26 of the club head 12*c*. This additional weight would thereby result in an increased overall size for the club head and larger sole and/or a higher toe dimension.

By way of example, there is included hereinafter a table illustrating certain features of a typical set of clubs constructed in accordance with the present invention. In this regard, there is included the blade loft in degrees, dimension "Y" in the drawings, the club head weight in grams, the volume of the cavity 30 for each club, expressed in terms of grams of weight removed due to the cavity presence, and size and the general length of the cavity along the club face, dimension "Z" of the drawings.

| CLUB NO. | BLADE LOFT ("Y") | CLUB HEAD WT. (GRAMS) | CAVITY VOL. *1 | CAVITY DIMENSION *2 |
|---|---|---|---|---|
| 2 | 22 deg. | 235 gr. | 20 gr. | 1.85 in. |
| 3 | 25 | 242 | 19 | 1.81 |
| 4 | 27 | 249 | 18 | 1.77 |
| 5 | 29.5 | 256 | 17 | 1.73 |
| 6 | 33 | 263 | 16 | 1.69 |
| 7 | 36 | 270 | 15 | 1.65 |
| 8 | 40 | 277 | 14 | 1.61 |
| 9 | 44 | 284 | 13 | 1.57 |
| Pitching Wedge | 48 | 293 | 12 | 1.53 |

*1 Cavity volume is expressed in grams of weight removed due to cavity presence and size.

*2 The cavity dimension is expressed in the length of the cavity - reference characters Za, Zb and Zc, FIGS. 1–3.

The lengths Xa–c of the hosels 16, as well as the volume of the cavities 30*a–c* vary progressively in the preferred embodiment of the invention illustrated and described. While progressive changes in hosel length and cavity volume are preferred in order to attain precise control and balancing, it is anticipated that many of the advantages of the present invention can be attained with only intermittent variance; as for example the hosel length and cavity size for several iron clubs in the set may remain constant, viz., the one-iron, two-iron and three-iron, or the more lofted clubs such as a pitching wedge and sand wedge. Thus, it is not intended that the present invention be limited to progressive variance in the hosel length and/or the cavity size, whether these features are used separately or in combination.

With regard to FIGS. 7–8, it should be noted that each club head includes a rib or rim 38 extending about the periphery of the back portion 20 of the club. In practice, the club heads 12*a–c* are cast and are finished by a foundry and provided to the golf club manufacturer for assembly to the club shaft. In the assembly of golf clubs to precision tolerances, it often becomes necessary to add or remove a slight amount of weight with respect to the club head in order to maintain a constant swing weight for the various clubs of the iron set. The provision of the rim 38 is extremely advantageous, in that it gives the club assembler the ability and option to grind off a small portion of the club head without disturbing the finish of the back portion of the club interiorly of the rim 38. That is to say, the area of the club bounded by the rim 38 is generally finished with the manufacturers trademark, model designation, and often the club number. With the present invention, the weight of the club head can be precisely controlled through grinding of rib 38 without disturbing the finish of the interior portion. To facilitate this procedure, the rearwardly facing surface 40 on the rim 38 is substantially planar, however, a non-planar rib may be employed.

While a particular embodiment of the invention has been illustrated and described, it is not intended that this embodiment be limiting with respect to the overall invention. It is readily appreciated that once in possession of the present disclosure those skilled in the art may devise various changes and/or modifications without departing from the invention in its broadest aspects. As such, the scope of the present invention is not to be limited by the particular embodiment or specific construction illustrated and described. Accordingly, it is intended that the appended claims should cover all changes and/or modifications as fall within the true spirit and scope of the invention, as defined by said claims.

The invention is claimed as follows:

1. A set of golf clubs including at least a first and a second club, each club comprising a club head and a shaft, each club head including a hosel portion to which the shaft is attached and a blade portion, said blade portion including, a substantially planar face for striking a golf ball and a back portion opposite said planar face, the substantially planar faces on the respective club heads of the set being disposed at varying angles with respect to a vertical datum line to provide progressive degrees of loft, such that the planar face on the first of said club heads is disposed at a lesser angle to said datum line than is the planar face on the second one of said club heads in said set, the back portions of each said first and second club heads including a cavity formed therein, and the cavity in said first club head being of a larger volume than the cavity in said second club head, with the volume of the cavities in said clubs decreasing from the lower lofted clubs of said set to the higher lofted clubs, and the length of the hosel portion on said first club being shorter than the hosel portion on said second club with the hosel length on said clubs increasing from the lower lofted clubs to the higher lofted clubs of said set, such that the hosel length may be selected to provide a relatively uniformly located center of mass for each club head in the set.

2. A set of golf clubs according to claim 1, wherein the cavity formed in the back portion of each club head is disposed in a substantially uniform location with respect to the hosel, with the cavity extending along the length of the club head blade toward the toe portion of the blade, the cavity defined in said first club head thereby being longer than the cavity in said second club head.

3. A set of golf clubs according to claim 1, wherein each club head includes a rib portion extending outwardly from the back portion thereof and extending about the periphery of said back portion, which rib portion may be ground off to adjust the overall weight of the club head as desired.

4. A set of golf clubs according to claim 1, wherein the volume of the cavities decreases progressively from the lower lofted clubs toward the higher lofted clubs of the set, such that each club in said set has a progressively smaller size cavity.

5. A set of golf clubs according to claim 1, wherein the length of said hosel portion increases progressively, such that each club in said set has a progressively longer hosel portion.

6. A set of golf clubs including at least a first and a second club, each club comprising a club head and a shaft, each club head including a hosel portion to which the shaft is attached and a blade portion, said blade portion including, a substantially planar face for striking a ball, and a back portion disposed opposite said planar face, said substantially planar faces on the respective club heads of the set being disposed at varying angles with respect to a vertical datum line to provide progressive degrees of loft such that the planar face on said first club head is disposed at a lesser angle to said datum line than is the planar face on the second one of said club heads in said set, the back portions of each said first and second club heads being provided with a cavity, extending along the length of the blade portion, the cavity in said first club head being of a larger volume than the volume of the cavity in said second club head with the volume of the blade cavities in the clubs of said set decreasing from the lower lofted clubs of the set to the higher lofted clubs whereby the mass of each club head can be distributed along the blade such that the lower lofted clubs can have a greater percentage of their mass allocated to the toe and sole portions of the club head.

7. A set of golf clubs according to claim 6, wherein the cavity in each said blade back portion is disposed in a substantially uniform location relative to the hosel portion, with the cavity extending along the length of the blade toward the toe of said blade, with the length of the cavities decreasing from the lower lofted clubs toward the higher lofted clubs of said set.

8. A set of golf clubs according to claim 7, wherein the length of the hosel portion of said clubs increases from the lower lofted clubs to the higher lofted clubs.

9. A set of golf clubs according to claim 8, wherein said hosel portions increase in length progressively.

10. A set of golf clubs according to claim 9, wherein the hosel length increases by 0.1 inch per club.

11. A method of providing a set of golf clubs irons with a substantially uniform swing weight and a substantially uniform location of the blade for the center of mass for each club in the set, wherein the lower lofted clubs have lighter club heads and longer shafts than the higher lofted clubs, with the weight of the club heads increasing as the length of the shaft decreases from the lower lofted irons to the higher lofted irons, said method including the steps of: providing a series of club heads with the club heads each including a hosel portion and a blade portion with a cavity formed in the back of each said blade and a blade face formed on the front of said blade, and the club heads increasing in mass as the degree of loft of the blade face increases; varying the volume of the cavities in said blades such that the lowest lofted club of said set has the largest volume cavity, with the volume of the cavities decreasing from the lower lofted clubs toward the higher lofted clubs; and adjusting the length of the hosel portion on said club heads such that the lowest lofted club has the shortest hosel portion, with the hosel portion increasing in length from the lower lofted clubs toward the higher lofted clubs.

12. A method according to claim 11, wherein the steps of varying the volume of the cavities and the length of said hosel portions, bot include the step of progressively varying said volume and length

* * * * *